US006134794A

United States Patent [19]

Raukola

[11] Patent Number: 6,134,794

[45] Date of Patent: Oct. 24, 2000

[54] SIGHTING DEVICE FOR AN ARCHERY BOW

[76] Inventor: Janne Raukola, Ketunpolku 4 as 7, Fin-40270 Palokka, Finland

[21] Appl. No.: 09/213,137

[22] Filed: Dec. 18, 1998

[51] Int. Cl.[7] ..... F41G 1/00; F41B 5/00

[52] U.S. Cl. ..... 33/265; 124/87

[58] Field of Search ..... 33/265; 124/86, 124/87, 88

[56] References Cited

U.S. PATENT DOCUMENTS

| | | | |
|---|---|---|---|
| Re. 36,266 | 8/1999 | Gibbs | 33/265 |
| 2,642,661 | 6/1953 | Fredrickson | 124/87 |
| 2,959,860 | 11/1960 | Kowalcyk | 124/87 |
| 3,013,336 | 12/1961 | Pennington | 124/87 |
| 3,271,863 | 9/1966 | Harrington | 124/87 |
| 3,355,809 | 12/1967 | Guyton | 124/87 |
| 3,475,820 | 11/1969 | Kernan | 124/87 |
| 3,477,130 | 11/1969 | Egan | 124/87 |
| 3,568,323 | 3/1971 | Lendway | 124/87 |
| 3,623,468 | 11/1971 | Crest | 124/87 |
| 4,224,741 | 9/1980 | Perry | 33/265 |
| 4,356,758 | 11/1982 | Teiling | 89/41 E |
| 4,417,403 | 11/1983 | Strange | 124/87 |
| 4,532,717 | 8/1985 | Watson et al. | 33/265 |
| 5,092,052 | 3/1992 | Godsey | 33/254 |
| 5,465,491 | 11/1995 | Thell | 33/265 |
| 5,685,081 | 11/1997 | Winger | 33/265 |
| 5,735,053 | 4/1998 | McGunigal | 33/265 |
| 5,850,700 | 12/1998 | Capson et al. | 33/265 |
| 5,864,958 | 2/1999 | Giddens | 33/265 |
| 5,920,996 | 7/1999 | Hurckman et al. | 33/265 |
| 5,975,069 | 11/1999 | Hamm et al. | 124/87 |

OTHER PUBLICATIONS

*Third New International Dictionary, Unabridged*, G. & C. Merrian Co. Springfield, MA p. 337, 1964.

*Primary Examiner*—Randy W. Gibson
*Attorney, Agent, or Firm*—Fildes & Outland, P.C.

[57] ABSTRACT

An adjustable sighting device for an archery bow includes a frame part that is attached to the bow. The sighting device is equipped with an arcuate gauge that is fitted onto its rear part, and a lever that is supported from its middle onto the frame part with the help of a shaft and which turns in a plane. The shaft includes a rear portion, an intermediate portion and a front portion, and the rear portion of which is equipped with a pointer that is set to cooperate with the arcuate gauge, and in which the front portion of the lever includes a sighting bead that is supported in slightly spaced relation from and at the side of the said plane with the help of the transverse part, and a side-shift member for the sighting bead by which the latter can be adjusted to move sideways.

8 Claims, 2 Drawing Sheets

SIGHTING DEVICE FOR AN ARCHERY BOW

FIELD OF THE INVENTION

This invention relates to an adjustable sighting device, which is intended to be attached onto an archery bow, for example, a compound bow.

BACKGROUND OF THE INVENTION

There are many different sighting devices, for compound bows that are used for hunting. U.S. Pat. No. 4,541,179 presents a known sighting device, in which the sighting bead is protected from outer shocks by an aluminum ring. The side adjustment of the sighting bead is carried out by regulating the free length of the supporting bolt, which requires a set wrench. The side adjustment of other known sighting devices also generally requires the use of tools.

SUMMARY OF THE INVENTION

An object of the present invention is to simplify and to reduce the size of the sighting device, and to create a sighting device that is easier to use than before.

Accordingly, the present invention provides a sighting device which includes a frame part that is attachable to an archery bow. The frame is equipped with an arcuate gauge that is fitted onto its rear part, and a lever that is supported from its middle onto the frame part with the help of a shaft and which turns in a plane. The Cardan shaft includes a rear portion, an intermediate portion and a front portion. The rear portion is equipped with a pointer that is set to co-operate with the arcuate gauge. The front portion of the lever includes a sighting bead that is supported in slightly spaced relation from and at the side of the said plane with the help of the transverse part, and a side-shift member for the sighting bead by which the latter can be adjusted to move sideways.

In addition to the side adjustment being done by a sideways movement in the sighting device according to the invention, the sighting bead can be pulled back in order to protect it when the sight is not being used.

These and other features and advantages of the invention will be more fully understood from the following detailed description of the invention taken together with the accompanying drawings.

DETAILED DESCRIPTION OF THE INVENTION

Figure 4:
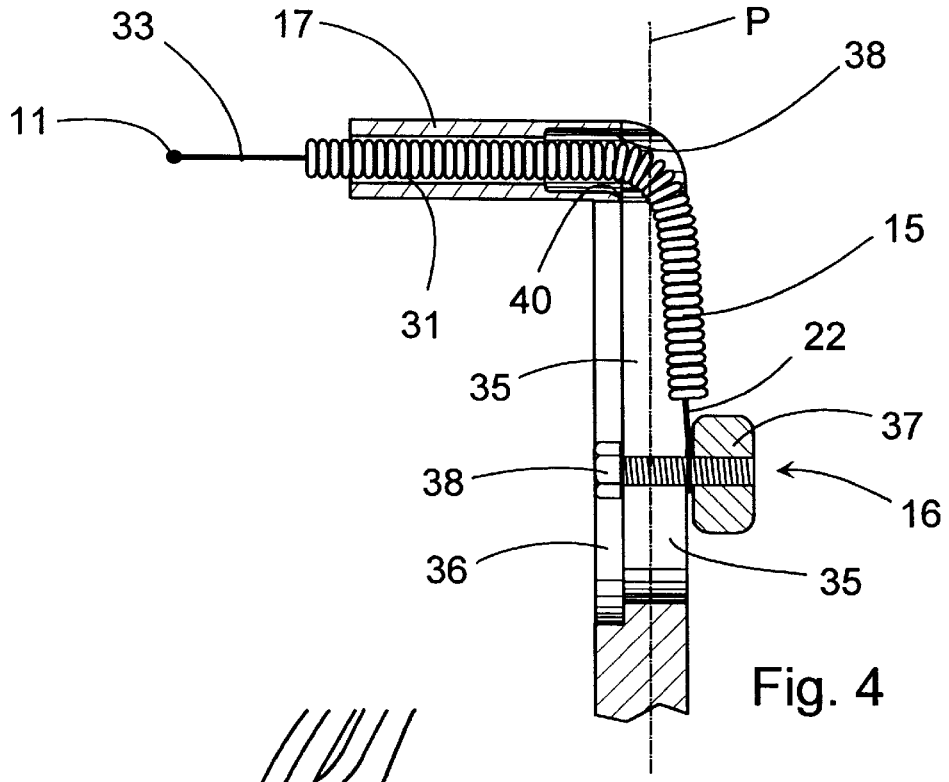
FIG. 4 is a cut-away view of the side-shift member of the sighting device.
Figure 3:
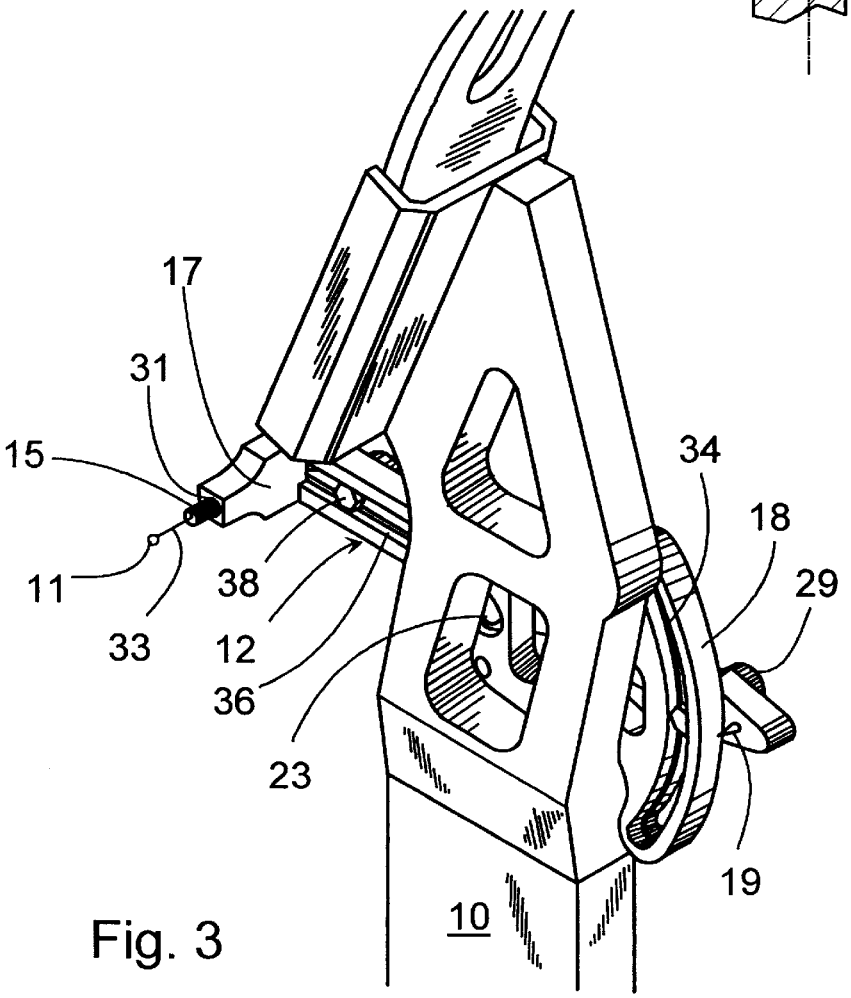
FIG. 3 is an elevational view of the sighting device as seen from the other side in relation to FIG. 2.

Referring now to the drawings in detail, the main parts of the sighting device are a frame 14 and a lever 12, which is supported with the help of a shaft 23 from the frame and is able to turn on top of the frame 14 in a plane shown in FIGS. 3 and 4. The frame 14 and the lever 12 of the sighting device can be manufactured by spray casting in a steel mold. The manufacturing material is preferably nylon material. Alternatively, the parts can be manufactured out of aluminum by mechanization.

The sight is attached to the frame of a compound bow 10 in ready-made holes according to the AMO (Archery Manufacturers & Merchants Organization) standards.

Figure 1:
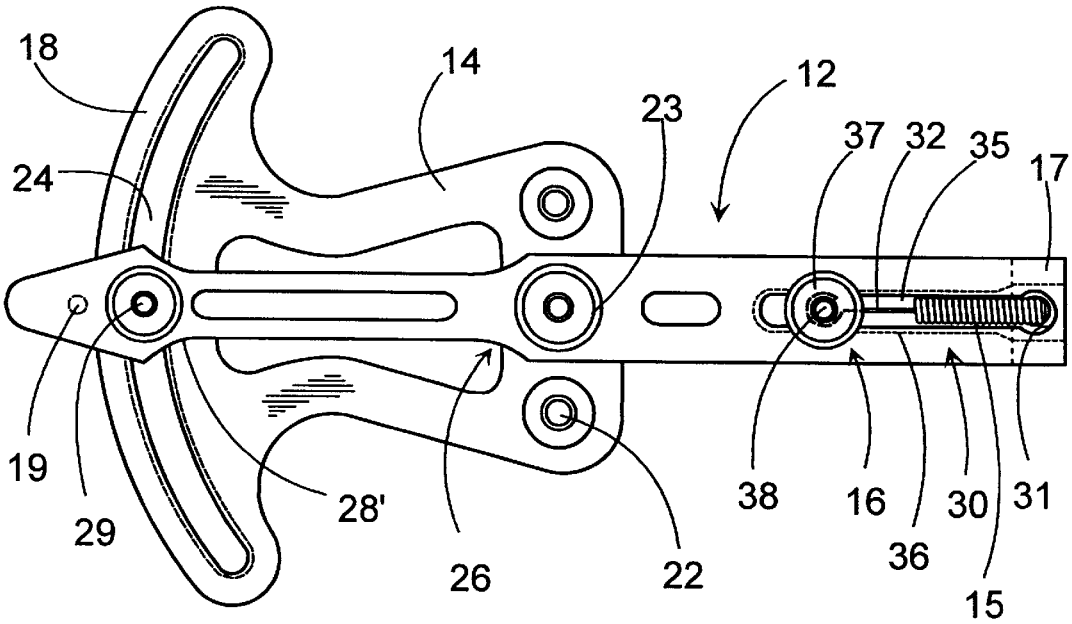
FIG. 1 is a plan view of a sighting device constructed in accordance with the present invention.
Figure 2:
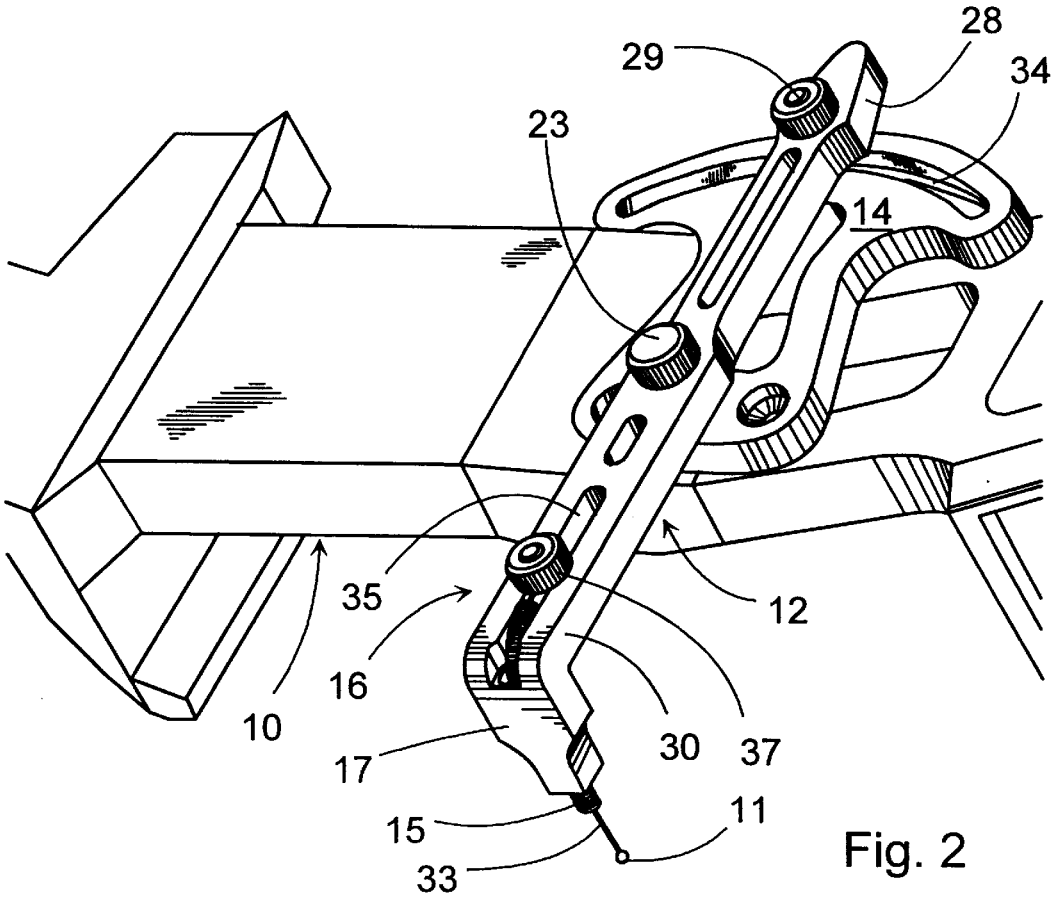
FIG. 2 is an axonometric visualization of the sighting device attached to an archery bow.

Referring to FIG. 1, an arcuate gauge 18 defines one end of frame 14, onto which gauge a measure scale sticker can be attached according to the characteristics of the compound bow. A pointer 19 that is set to co-operate with measure scale 18 is situated at the rear portion 28 of lever 12 (FIG. 3). Lever 12 is locked into the desired position in relation to frame 14 with the help of lock 29, which is able to move within loop 34.

The side-shift members of sighting bead 11 are located at the front portion 30 of lever 12. Sighting bead 11 is attached onto a flexible shaft 15, preferably a coil spring, which is locked from one side onto slide 16. Coil spring 15 includes a straight attachment head 33 for supporting sighting bead 11, and an attachment link 32 for attaching the coil spring 15 onto slide 16, more precisely around bolt 38.

The flexible shaft 15, which is formed by the coil spring, moves in pipe part 31 which leads its movement sideways, i.e. crosswise. The transverse part 17 and thereby the pipe part 31 are preferably in a straight angle in relation to the longitudinal portion of lever 12.

Referring to FIG. 4, coil spring 15 bends about 90° from the movement direction of slide 16 in the direction determined by pipe part 31. The longitudinal movement of slide 16 turns into a crosswise movement. Slide 16 moves inside loop 35 and it is formed by bolt 38 and nut 37. The head of bolt 38 moves inside the widening 36 of the loop 35. In order to facilitate the turning of the flexible shaft or coil spring 15, pipe part 31 ends in a widening 38 on the side of the slide. The length of the widening 38 is 15–40% of the total length of the pipe part and the diameter of which is 15–50% bigger than any other portion of the pipe part. There is further a bevelling 40 in the exit hole of the widening at the side of the slide, which bevelling facilitates the turning of the coil spring 15.

The flexible shaft or coil spring 15 with its attachment link 32 and attachment head 33, is measured according to the scale of the slide and the pipe part 31, so that the sighting bead 11 can be pulled back so that it is protected inside the pipe part, whereby it will not be damaged during transportation. The sighting bead 11 is, for example, formed out of a red plastic drop at the end of the attachment head 33. Otherwise the color of the whole flexible shaft and the sighting part is black.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An adjustable sighting device for an archery bow, which sighting device includes a frame part that is attached onto a bow, equipped with an arcuate gauge that is fitted onto its rear part, and a lever that is supported from its intermediate portion onto a frame part with the help of a shaft and which turns in a plane, including a rear portion, an intermediate portion and a front portion, and the rear portion of which is equipped with a pointer that is set to co-operate with the arcuate gauge, and in which the front portion of the lever includes a sighting bead that is supported in slightly spaced relation from and at the side of the said plane with the help of a transverse portion of the lever, and a side-shift member for the sighting bead by which the sighting bead can be adjusted to move sideways, characterized in that the side-shift member includes a flexible shaft that supports the sighting bead on one side, a pipe part that is fitted onto the transverse portion and which is set to loosely support the flexible shaft, an essentially longitudinal, adjustable slide that is fitted onto the front portion of the lever and which binds the opposite end of the flexible shaft that comes out from the pipe part and is bent longitudinally, whereby the flexible shaft, supported from the pipe part turns in the direction of the slide to a crosswise movement and the sighting bead moves in the direction of the pipe part.

2. The sighting device according to claim 1, characterized in that the flexible shaft is a coil spring.

3. The sighting device according to claim 1, characterized in that the coil spring includes a straight attachment head in order to attach the sighting bead at one end, and a link end at the opposite end in order to attach it onto the slide.

4. The sighting device according to claim 1, characterized in that the pipe part includes a widening that reaches into the exit hole on the side of the slide, the diameter of which widening is 15–50% bigger that any other portion of the pipe part.

5. The sighting device according to claim 4, characterized in that the length of the widening is 15–40% of the whole length of the pipe part.

6. The sighting device according to claim 5, characterized in that the opening of the pipe part includes a bevelling at the side of the slide.

7. The sighting device according to claim 1, characterized in that the lever member is essentially an L-model, and the pipe part is formed onto its shorter arm.

8. The sighting device according to claim 1, characterized in that the slide is formed into a loop of the longitudinal portion of the lever, which loop reaches onto the opening of the pipe part.

* * * * *